United States Patent [19]

Ishibashi

[11] 4,440,057

[45] Apr. 3, 1984

[54] ELECTRONIC MUSICAL INSTRUMENT WITH IMPROVED INPUT DEVICE

[75] Inventor: Masanori Ishibashi, Ome, Japan

[73] Assignee: Casio Computer Co., Ltd., Tokyo, Japan

[21] Appl. No.: 409,282

[22] Filed: Aug. 18, 1982

Related U.S. Application Data

[63] Continuation of Ser. No. 210,410, Nov. 25, 1980, abandoned.

[30] Foreign Application Priority Data

Nov. 30, 1979 [JP] Japan ..... 54-155288

[51] Int. Cl.[3] ..... G10H 1/00

[52] U.S. Cl. ..... 84/1.01; 84/1.18

[58] Field of Search ..... 84/1.01, 1.17, 1.18, 84/1.22, 464, 478; 307/116; 340/365 C, 365 R, 365 VL, 805

[56] References Cited

U.S. PATENT DOCUMENTS

| | | | |
|---|---|---|---|
| 3,808,344 | 4/1974 | Ippolito et al. | 84/1.17 |
| 3,974,472 | 8/1976 | Gould, Jr. | 307/116 |
| 4,017,848 | 4/1977 | Tannas, Jr. | 340/365 R |
| 4,023,457 | 5/1977 | Kirkwood et al. | 84/1.17 |
| 4,078,257 | 3/1978 | Bagley | 340/365 VL |
| 4,121,204 | 10/1978 | Welch et al. | 340/365 C |
| 4,212,011 | 7/1980 | Waldron | 340/805 |

FOREIGN PATENT DOCUMENTS

| | | |
|---|---|---|
| 1299749 | 7/1969 | Fed. Rep. of Germany . |
| 1087387 | 10/1967 | United Kingdom . |
| 1385765 | 2/1975 | United Kingdom . |
| 1429682 | 3/1976 | United Kingdom . |
| 1539649 | 1/1979 | United Kingdom . |
| 1551960 | 9/1979 | United Kingdom . |
| 1553563 | 10/1979 | United Kingdom . |
| 2022872 | 12/1979 | United Kingdom . |

*Primary Examiner*—F. W. Isen

*Attorney, Agent, or Firm*—Frishauf, Holtz, Goodman and Woodward

[57] ABSTRACT

A transparent operation plate is disposed on the operation panel of an input device in correspondence with tone information to be input. A pair of touch contacts are formed exposed on the surface of each transparent operation plate. A liquid crystal display element is disposed immediately below the transparent operation plate. The liquid crystal element displays characters representing the tone information, as well as the information input operation condition. This display can be visually confirmed through the transparent operation plate.

8 Claims, 14 Drawing Figures

ELECTRONIC MUSICAL INSTRUMENT WITH IMPROVED INPUT DEVICE

This is a continuation of application Ser. No. 210,410 filed Nov. 25, 1980, now abandoned.

BACKGROUND OF THE INVENTION

The present invention relates to an input device for an electronic musical instrument for setting the volume, timbre, rhythm, etc. for performance.

A drawbar device is known as an input device for an electronic musical instrument such as an electronic organ. A conventional drawbar device comprises a slide volume or a slide switch of the multi-contact type. The drawbar device of this type is defective in that disorders such as loose connections tend to occur. Since the output of the drawbar device using a slide volume or a slide switch is an analog signal, A/D conversion is required for using it with an electronic organ for generating tones digitally. The device is further defective in that the confirmation of set information by visual observation during performance is difficult when the operating knobs of the slide volume or slide switch which are mounted on the operation panel of the electronic organ are operated. Although various devices for inputting volume, rhythm and so on are being used in addition to the drawbar device as input devices for electronic musical instruments, these devices also have problems similar to those of the drawbar device.

It is the primary object of the present invention to provide an input device for an electronic musical instrument that operates in a stable manner for an extended period of time, is simple in construction, and is so constructed that the set information may be easily confirmed visually during performance.

SUMMARY OF THE INVENTION

To accomplish the above and other objects, the present invention provides an input device for an electronic musical instrument for selectively setting tone information such as volume and timbre to be generated by operation of the performance keys of a keyboard, which comprises a plurality of touch switches having transparent operation plates for generating the tone information, and a display device for displaying the tone information generated by the touch switches for visible display through the transparent operation plates.

DETAILED DESCRIPTION

Figure 1:
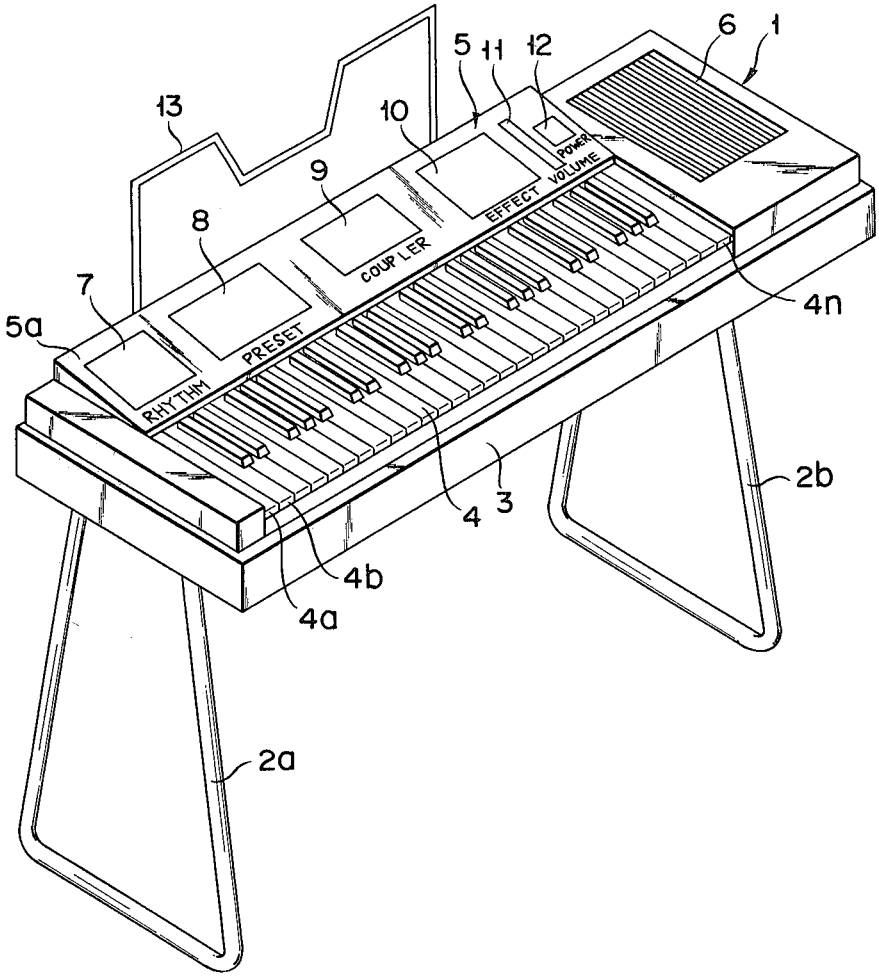
FIG. 1 is a perspective view of an electronic organ having an input device according to one embodiment of the present invention.

Referring to FIG. 1, an electronic organ 1 comprises support legs 2*a* and 2*b*, and a machine body 3 supported on these support legs 2*a* and 2*b*. These support legs 2*a* and 2*b* may be constructed to be detachable for use as needed. The machine body 3 comprises a keyboard 4 having a plurality of performance keys 4*a*, 4*b*, . . . 4*n*; a specifying display unit 5 of the input device formed on an operation panel 5*a*; and a speaker 6. A rhythm specifying display unit 7, a preset timbre display unit 8, a coupler specifying display unit 9, an effect specifying display unit 10, a volume specifying display unit 11, and a power switch 12 are disposed on the specifying display unit 5 and are separated from each other by a predetermined distance. A music stand 13 is mounted on the back surface of the machine body 3. The surface portions of the specifying information display units 7 to 11 and the power switch 12 comprise transparent operation plates of touch switches to be described hereinafter.

Figure 2:
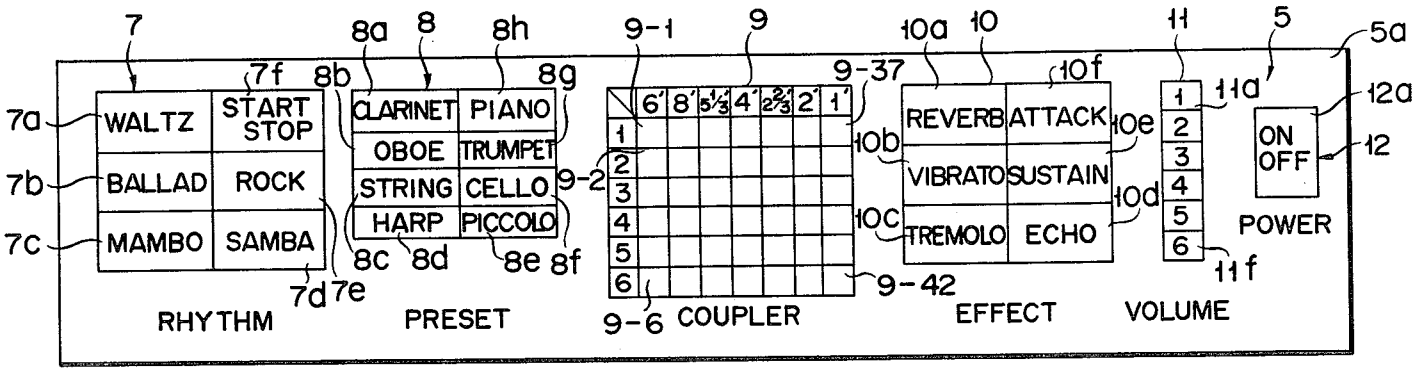
FIG. 2 is a plan view of the specifying display unit formed on the operation panel of the input device of FIG. 1.

The surface area of the rhythm specifying display unit 7 is divided into six transparent operation plates 7*a* to 7*f* of touch switches for inputting rhythms i.e., waltz, ballad, mambo, samba, and rock as shown in FIG. 2. The desired rhythm information may be input by lightly touching these plates with a finger. The transparent operation plate 7*f* comprises a touch switch for specifying the start and termination of the generation of the rhythm pattern during performance. Liquid crystal display (LCD) devices to be described hereinafter are each disposed below the transparent operation plates 7*a* to 7*f* so that characters displayed by the liquid crystal display devices may be observed through the transparent operation plates 7*a* to 7*f*. This visual display state of characters in FIG. 2 is accomplished under the condition that the power switch 12 is ON and none of the touch switch operation plates 7*a* to 7*f* is operated. When any of the operation plates 7*a* to 7*f* is operated, the blank part around the appropriate characters, of "WALTZ", for example, is displayed in color. This will be described in more detail later. The other information specifying display units 8 to 11 are basically constructed in a manner similar to that of the rhythm specifying display unit 7, so that the touch switches and the liquid crystal display devices overlap each other.

The preset timbre display unit 8 is used as an input device for setting the timbre of the tones to those of various musical instruments such as the clarinet, oboe, strings, harp, piccolo, cello, trumpet, and piano. The preset timbre display unit 8 comprises touch switch transparent operation plates 8*a*, 8*b*, 8*c*, 8*d*, 8*e*, 8*f*, 8*g*, and 8*h* arranged in correspondence with the various musical instruments. When the power switch 12 is ON, the names of the various musical instruments are displayed by characters as shown in the figure.

The coupler specifying display unit 9 functions as a drawbar of a conventional electronic organ and is so constructed as to specify tones of respective feet 16′, 8′, $5\frac{1}{3}$′, 4′, $2\frac{2}{3}$′, 2′, 1′ of a flute, for example, by weighting them in six steps. The coupler specifying display unit 9 may also be constructed to specify feet tones of another musical instrument other than the flute. In case a musical tone is obtained by synthesizing sinewaves, feet tones of the sinewaves may be specified. In this case, characters representing the feet numbers 16′, 8′, $5\frac{1}{3}$′, 4′, $2\frac{2}{3}$′, 2′, and 1′ and weighting numbers 1 to 6 are displayed by liquid crystal display devices when the power switch 12 is ON. Therefore, $7\times6=42$ transparent operation plates 9-1, 9-2, . . . 9-42 are used for specifying the feet. These transparent operation plates 9-1 to 9-42 are actuating units of 42 touch switches. When no operation is made when the power switch 12 is ON, the liquid crystal display devices disposed thereunder do not present any display.

Further touch switches are provided at the portions where the characters 16′, 8′, $5\frac{1}{3}$′, 4′, $2\frac{2}{3}$′, 2′, 1′, are displayed. The further touch switches are used for preventing the respective feet tones from being generated. Thus, the total number of touch switches becomes $42+7=49$. For obtaining 16′ with a weighting of the first step, it suffices to touch the surface of the transparent operation plate 9-1 with a finger. Then, the liquid crystal display element under the transparent plate 9-1 is driven, and part of the transparent operation plate 9-1 is displayed black for easy recognition. When a finger touches the surface of the transparent operation plate 9-6, for example, under this condition, all six liquid crystal elements below the operation plates 9-1 to 9-6 are driven, and the column for 16′ feet changes to black.

The effect specifying display unit 10 is for inputting various effects for tones such as vibrato or attack. Six transparent operation plates 10*a*, 10*b*, 10*c*, 10*d*, 10*e*, and 10*f* of six touch switches are arranged in two columns. Transparent operation plates 10*a* to 10*f* are used for inputting the effects of reverberation, vibrato, tremolo, echo, sustain, and attack, respectively. FIG. 2 shows a case in which the power switch 12 is ON, and none of the transparent operation plates 10*a* to 10*f* is operated by touching.

The volume specifying display unit 11 comprises six transparent operation plates 11*a*, 11*b*, 11*c*, 11*d*, 11*e* and 11*f* arranged in a column for changing the volume of the tones in six steps. Six liquid crystal display elements for representing the numerals 1 to 6 when the power source is ON are disposed below the transparent operation plates 11*a* to 11*f*.

The power switch 12 is a touch switch which has a transparent operation plate 12*a* on the surface of which is written ON and OFF. When the power source 12 is OFF, the liquid crystal display device disposed below the transparent operation plate 12*a* is not driven, and the background of the characters, ON and OFF is blank, as shown in the figure. When the power switch 12 is ON, the liquid crystal display device is driven, and substantially the whole background area changes to black. Such a form of display will be referred to as a "mask display" hereinafter.

Thus, the information specifying display units are so constructed that the liquid crystal display devices overlap below the touch switch transparent operation plates. The construction of the information specifying display units will be described in more detail referring to FIG. 3A.

Figure 3B:
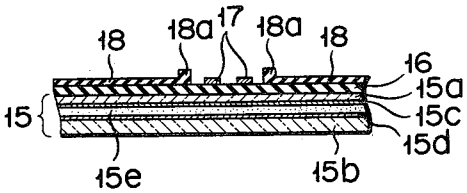
FIG. 3B is a partial sectional view of another example of the specifying display unit of FIG. 2.
Figure 3A:
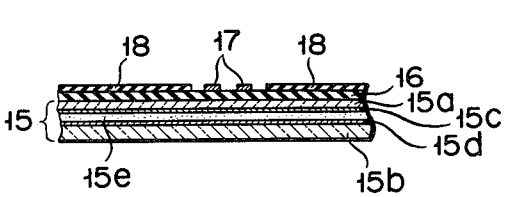
FIG. 3A is a partial sectional view of one example of the specifying display unit of FIG. 2.

In FIG. 3A, a reference numeral 15 denotes a liquid crystal display device. The liquid crystal display device 15 is constructed with a first transparent electrode 15*c* provided on a glass plate 15*a*, a second transparent electrode 15*d* deposited on a glass plate 15*b* and a liquid crystal plate 15*e* provided between the electrodes 15*c* and 15*d*. The first and second transparent electrodes 15*c* and 15*d* have a pattern of a character or a mask pattern being displayed on the specifying display units 7 to 12. For the sake of simplicity a polarizing plate is omitted in FIG. 3A. A transparent substrate 16 having a transparent wiring for a touch switch 17 is provided on the upper surface of the liquid crystal display device 15. The touch switch 17 has two exposed transparent electrodes one of which is a plus electrode and the other is a minus electrode. By touching both the tip of the exposed electrodes with a finger, the touch switch 17 enters the ON state. The surface of the transparent substrate 16 except a portion where the touch switch 17 is provided is covered with a cover plate 18 for protecting the wiring for the touch switch 17.

FIG. 3B shows the construction of another example of the information specifying display units 7 to 12, where similar or the same portions thereof as those of FIG. 3A are denoted by the same reference numerals. In the example of FIG. 3B, a cover plate 18 has a guide 18*a* provided around the touch switch 17 and projected from the level of the cover plate 18. The operator can identify easily the portion of the touch switch 17 by looking at the projected guide 18*a* at the time of operation of the touch switch 17.

Figure 4:
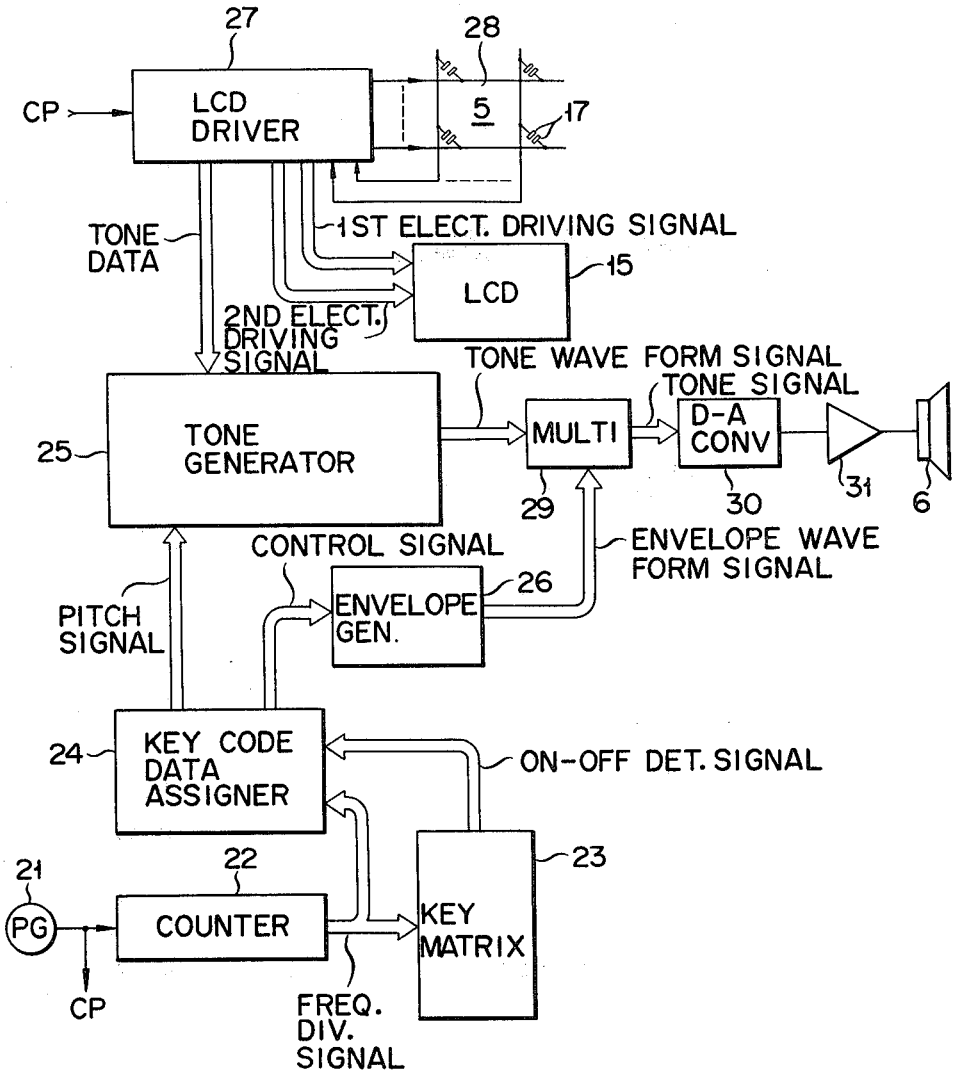
FIG. 4 is a block diagram illustrating the overall circuit construction of the electronic organ shown in FIG. 1.

FIG. 4 is a block diagram illustrating the construction of the electronic circuit housed inside the machine body 3 of the electronic organ of FIG. 1. In FIG. 4, a clock pulse CP of a predetermined frequency outputted from a pulse generator (PG) 21 is input to a counter 22, and the frequency is divided. The signal, frequency-divided to a predetermined frequency, is supplied to a key matrix 23 and a key code data assigner 24. The key matrix 23 has a plurality of key switches at its respective matrix crossing points. These key switches are turned on and off by the operation of the performance keys 4*a* to 4*n*. The on-off operation is detected when the respective performance key is scanned by a frequency-divided signal outputted from the counter 22. An on-off detection signal thus obtained is also supplied to the key code data assigner 24. The key code data assigner outputs a pitch signal for specifying the pitch corresponding to the operated performance key and also outputs an envelope control signal for controlling the envelope waveform, in response to a frequency-divided signal supplied from the counter 22 and the on-off detection signal supplied from the key matrix 23. The outputted pitch signal is supplied to a tone generator 25, and the envelope control signal is supplied to an envelope generator 26 which generates an envelope waveform signal.

The tone information for determining the rhythm, timbre, volume and so on generated at the specifying display unit 5 is supplied as a preset input to the tone generator 25 through a liquid crystal driver 27. The specifying display unit 5 has a touch switch matrix 28, and a plurality of touch switches 17 disposed at the respective crossing points of the touch switch matrix 28. The touch switches 17 are disposed on the transparent operation plates of the respective information specifying display units 7 to 11. The liquid crystal driver 27 operates in response to the clock pulse CP from the generator 21 and dynamically drives a liquid crystal display device 15. Thus, the liquid crystal driver 27 supplies preset input data to the tone generator 25 and also supplies a first electrode driving signal and a second electrode driving signal to a pair of electrodes 15*c*, 15*d* of the liquid crystal device 15.

Figure 5A:
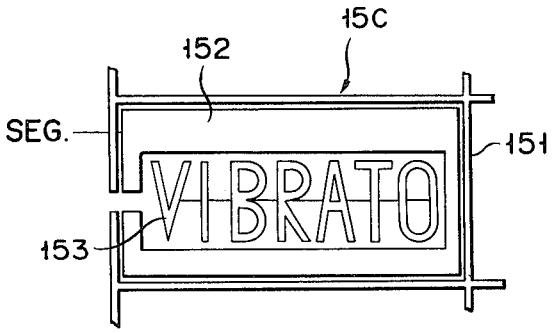
FIG. 5A is a plan view of a first transparent electrode of an LCD device used in the specifying display unit.
Figure 5B:
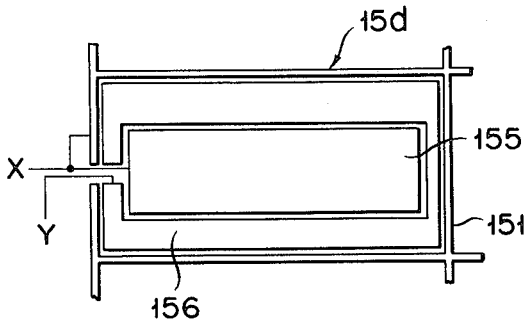
FIG. 5B is a plan view of a second transparent electrode of the LCD device.
Figure 5C:
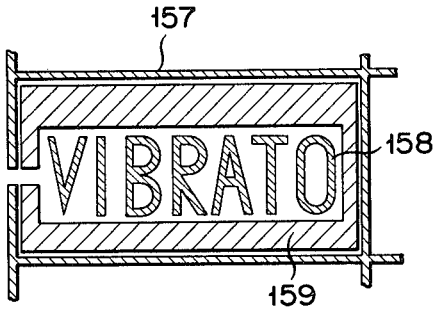
FIG. 5C is a plan view illustrating an example of the visible display condition of the specifying display unit.

There will now be described the construction and the operation of the effect specifying display unit 10. The liquid crystal display device 15 of the effect specifying display unit 10 is driven by, for example, a ½-bias and ½-duty drive system. FIG. 5A to FIG. 5C are enlarged views of the VIBRATO specifying display section in the effect specifying display unit 10.

Referring to FIG. 5A, there is shown a first electrode 15*c* of a liquid crystal display device 15 in the VIBRATO specifying display section. In the figure, a frame electrode 151, a mask display electrode 152 and a character display electrode 153 are connected to a drive signal line SEG.

Figure 6A:
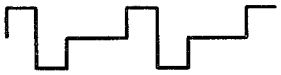
FIG. 6A to FIG. 6D show signal waveforms for driving the LCD device shown in the circuit of FIG. 4.
Figure 6B:
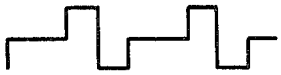
Figure 6C:
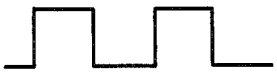

FIG. 5B shows a second electrode 15*d* of the liquid crystal display device 15, wherein the frame electrode 151 and a character display electrode 155 are connected to a drive signal line X and a mask display electrode 156 is connected to a drive signal line Y. A drive signal is supplied from the LCD device 27 to the drive signal lines SEG., X and Y to make a visible display. FIG. 6A shows a signal waveform supplied to the drive signal line X, and FIG. 6B shows a signal waveform supplied to the drive signal line Y. The drive signal line SEG. is supplied with a drive signal having a waveform as shown in FIG. 6C for displaying the frame 151 and the characters VIBRATO.

Figure 6D:
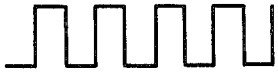

When the touch switch 17 of the VIBRATO display section is actuated, the drive signal line SEG. is supplied with a signal having a waveform as shown in FIG. 6D for driving the frame electrode 151, the electrode 153 of the character VIBRATO and the mask display electrode 156. FIG. 5C shows a grayed state of the liquid crystal sections 157, 158, 159 respectively positioned with respect to the electrodes 151, 153, 156.

The remaining specifying display units 7 to 9 and 11 each is also provided with transparent first and second electrodes to which prescribed drive signals are supplied from the LCD driver 27. Since the construction and operation thereof are similar to those of the effect specifying display unit 10, further explanation thereof is omitted here.

Figure 7:
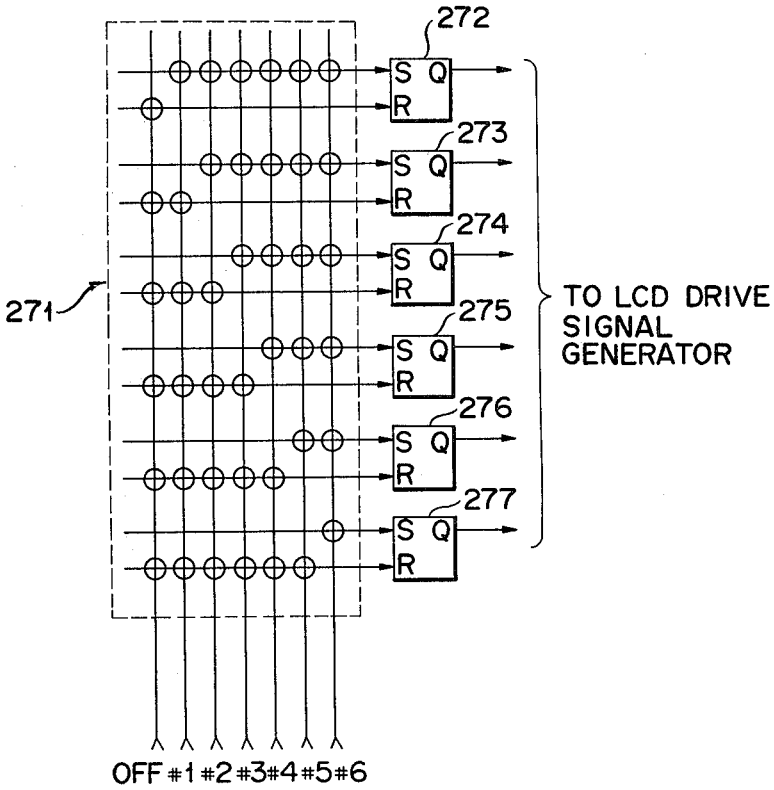
FIG. 7 shows a main part of a driver circuit of the LCD device shown in FIG. 4.

A driver circuit section of the LCD driver 27 for driving the coupler specifying display unit 9 will be explained here by referring to FIG. 7. The respective feet tones of the coupler specifying display unit 9 have weighting levels "1" to "6". Signals from the touch switches of the weighting levels "1" to "6" and touch switches for rendering the set feet tones OFF are supplied to the LCD driver 27. More detailed explanation of the operation of the coupler specifying display unit 9 will be given by taking a 16′ feet tone as an example.

The reference symbols OFF, #1 to #6 denote inputs delivered from the touch switches of the coupler specifying display unit 9. These inputs OFF, #1 to #6 are supplied to a decoder 271. The decoder 271 delivers control signals supplied to set, reset input terminals of six S-R type flip-flops 272 to 277. When a set output Q thereof is "1" level, this "1" output Q is supplied to an LCD drive signal generator (not shown) for obtaining a prescribed waveform signal by which a corresponding LCD display device is driven to give a visible display.

When an OFF command signal is supplied to the decoder 271, all the flip-flops 272 to 277 are reset in response to the output of the decoder 271. Accordingly, no visible display is given at the specifying display section of the 16′ feet. When a command signal of the weighting level "1" is supplied to the decoder 271, only the flip-flop 272 is set and the remaining flip-flops 273 to 277 are reset. Thus, only the position of the transparent operation plate 9-1 of the 16′ feet tone specifying display section in FIG. 2 is mask-displayed.

When a command signal of the weighting level "5" is supplied to the decoder 271, set signals are supplied to the flip-flops 272 to 276 from the decoder 271, leaving the flip-flop 277 in a reset state. As a result, positions of the transparent operation plates 9-1 through 9-5 of the 16′ feet tone specifying display section in FIG. 2 are mask-displayed and no visible display is given at the position of the plate 9-6. Though the circuit construction of the LCD driver 27 corresponding to 16′ feet tone is shown in FIG. 7, another circuitry in the LCD driver 27 corresponding to another feet tone may be constructed in a similar manner and the detailed description thereof may be omitted here.

In FIG. 4, the tone generator 25, based on the supplied pitch signal and the preset input data, prepares a tone signal of predetermined pitch, waveform and amplitude and supplies it to one input end of a multiplier 29. An envelope waveform signal is supplied to the other input terminal of the multiplier 29. The multiplier 29 synthesizes the tone signal and the envelope waveform signal to prepare a tone signal of a predetermined envelope and supplies it to a D/A converter 30. The D/A converter 30 converts the digital tone signal into an analog tone signal and supplies it to an amplifier 31. The analog tone signal amplified by the amplifier 31 is fed to the speaker 6 to be converted into a tone and outputted as a sound.

The mode of operation of the above embodiment will now be described. When the surface of the power switch 12 is touched when starting the performance, power is supplied to the overall circuitry, shown in FIG. 4, of the electronic organ. Then, the pulse generator 21 starts its oscillation operation and a clock pulse CP is supplied to the counter 22 and the liquid crystal driver 27. As a result, a frequency-divided signal is outputted from the counter 22. In response to the clock pulse CP, the liquid crystal driver 27 supplies first and second electrode driving signals to the liquid crystal display device 15. Then, the respective characters of the specifying display unit 5 are displayed by the liquid crystal. Since the liquid crystal device disposed below the power switch 12 is driven, the areas surrounding the characters ON and OFF change to black and are mask displayed, so that the power ON state may be easily and visually confirmed as shown in FIG. 8.

Subsequently, desired tone information is preset by selectively operating the information specifying display units 7 to 11 of the input device. For example, feet information of 16′, 8′, 5⅓′, 4′ and 2′ is loaded with weighting levels of 3, 5, 1, 2 and 1, respectively; vibrato is added to the tones; and the volume is set to the fourth level. In this case, the transparent operation plates 9-3, 9-11, 9-13, 9-20 and 9-31 of the coupler specifying display unit 9 are touched with a finger. Then, the surface of the transparent operation plate 10*b* of the effect specifying display unit 10 and the surface of the transparent operation plate 11*d* of the volume specifying display unit 11 are touched with a finger. Upon this operation, the touch switches disposed at the surfaces of the respective transparent operation plates are turned on, and ON signals are input to the liquid crystal driver 27 from the touch switch matrix 28. The liquid crystal driver 27 supplies the first and second electrode driving signals to the liquid crystal display device 15 for driving the liquid crystal elements located at positions corresponding to the touch switches which supplied the ON signal. As has been described above, at the coupler specifying display unit 9, among the respective feet rows, the liquid crystal elements at the weighting positions below the operated level numbers are all driven. For example, in the case of 16′, since the transparent operation plate 9-3 of the weighting level "3" has been operated, all of the liquid crystal elements below the transparent operation plates 9-1 to 9-3 as shown in FIG. 8 are driven and change to gray. The visible display of the length corresponding to the operated quantity of the drawbar of 16′ is obtained so that the operator may easily recognize the operated quantity. The other quantities, 8′, 5⅓′, 4′ and 2′, are similarly displayed.

When the transparent operation plate **10*b* of the effect specifying display unit 10 is operated, signals of FIGS. 6A and 6B are supplied to the second electrode shown in FIG. 5B and the signal shown in FIG. 6D is supplied to the first electrode of FIG. 5A. Both the first and second electrodes are provided to the liquid crystal element located below the operation plate 10*b*. In this case, the characters "VIBRATO" do not disappear, but remain displayed. As the result, the liquid crystal in the blank area surrounding the characters "VIBRATO" is driven, except for a narrow band in the immediate vicinity thereof, and changes to black for display. Accordingly, as shown in FIG. 5C, a liquid crystal display element 157 at the frame portion and a liquid crystal display element 158 at the character part are driven to be displayed as black by the first and second electrode driving signals respectively shown in FIGS. 6C, 6A and 6B supplied from the liquid crystal driving unit 27 when the power switch 12 is turned ON. A liquid crystal element 159 around the characters is driven so that the hatched part in FIG. 5C may be displayed in black by another first and second liquid crystal driving signals respectively shown in FIGS. 6D, 6A and 6B generated by the liquid crystal driving unit 27 in response to the ON signal of the touch switch 17 generated when the surface of the transparent operation plate 10*b*** is touched with a finger.

Figure 8:
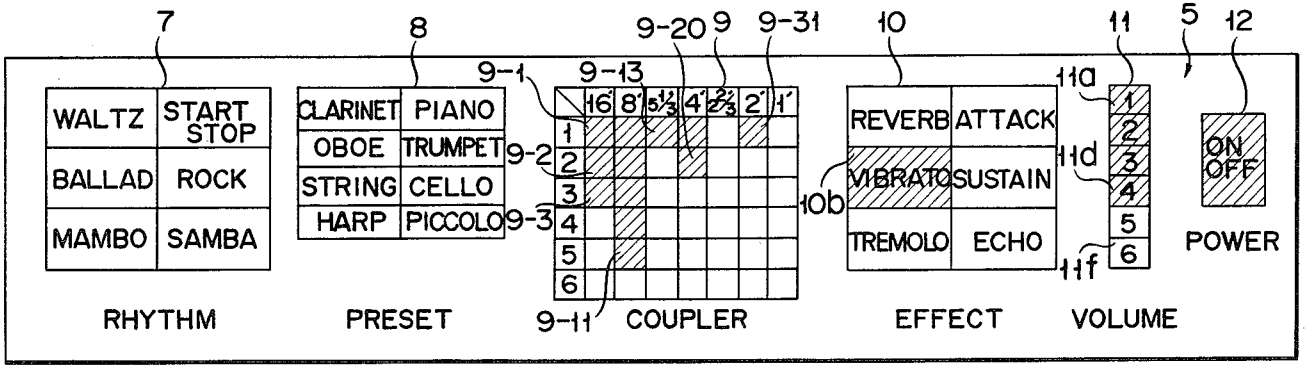
FIG. 8 is a plan view illustrating in detail the display condition of the specifying display unit of FIG. 5.

Since all the liquid crystal elements located below the transparent operation plates **11*a* to 11*d* are driven upon operation of the transparent operation plate 11*d* of the volume specifying display unit 11, it may be easily confirmed by the operator that the volume is set to the fourth level, as shown in FIG. 8**.

Of the input device, that is, the specifying display unit 5, the other parts i.e., the rhythm specifying display unit 7 and the preset timbre display unit 8 may be operated in a similar manner, so that desired tone information may be input and displayed at the same time.

When it is desired to change the input tone information, such input data may be easily changed by simply touching the surface of the transparent operation plate at the desired location. The displayed information is renewed at the same time.

Although the characters at the specifying display unit 5 were displayed by liquid crystal elements when the power switch is turned on in the above embodiment, these characters may be printed in advance on the transparent operation plates and the background of these characters may be displayed in black by driving the liquid crystal elements when the touch switch is ON. Further, the colors of the character part and the backgound part may be made different from each other by using colored liquid crystal display elements.

Although the tone information to be displayed included rhythm, timbre (kinds of the musical instruments), coupler (drawbar), effect and volume information, information specifying display units for other types of tone information may also be included.

It is also possible to use light emitting type display elements such as light emitting diodes instead of light receiving type display elements such as the liquid crystal display device. Instead of disposing the contacts of the touch switches on the transparent operation plates, they may be disposed directly on the surfaces of the transparent glass operation plate.

In summary, according to the input device of the present invention, touch switches are used and tone information is input by ON and OFF signals, so that defects due to loose connections tend not to occur, and conversion into digital information may be made easy. Furthermore, since the touch switches and the display devices are located at the same positions on the operation panel, visual confirmation of the input information is easy.

What is claimed is:

1. An electronic musical instrument comprising;

a plurality of performance keys selectively operable to cause the production of sounds corresponding to respective notes, detecting means coupled to said performance keys for detecting the operation of said performance keys, musical tone generating means coupled to said detecting means for generating musical tones designated by operated performance keys, and an input device coupled to said musical tone generating means for inputting tone information such as volume and timbre of tones selectively generated by said musical tone generating means upon operation of said performance keys, and wherein said input device further comprises:

a plurality of display devices, each having a plurality of display elements for displaying tone status of the musical tones generated by said musical tone generating means, a plurality of transparent touch switches located over said display devices for selectively inputting tone information, drive means coupled to said display devices and to said touch switches, and being responsive to operation of respective touch switches to cause said display elements respectively corresponding to the operated touch switches to visually display tone information input by the operated touch switches, and means coupled to said touch switches and to said musical tone generating means for transferring said tone information inputted by said touch switches to said musical tone generating means, whereby said musical tone generating means generates musical tones according to the tone information inputted by said touch switches.

2. An electronic musical instrument comprising;

a plurality of performance keys selectively operable to cause the production of sounds corresponding to respective notes, detecting means coupled to said performance keys for detecting the operation of said performance keys, musical tone generating means coupled to said detecting means for generating musical tones designated by operated performance keys, and an input device coupled to said musical tone generating means for inputting tone information such as volume and timbre of tones selectively generated by said musical tone generating means upon operation of said performance keys, and wherein said input device further comprises:

a plurality of display devices, each having a plurality of display elements for displaying tone status of the musical tones generated by said musical tone generating means, a transparent operation plate located over at least one of said display devices, a plurality of transparent touch switches for selectively inputting tone information, and wherein each of said touch switches includes a pair of transparent touch contacts exposed on the surface of said transparent operation plate, and each pair of said touch contacts corresponds to at least one of said display elements, drive means coupled to said display devices and to said touch switches, and being responsive to operation of respective pairs of contacts of said touch switches to cause said display elements respectively corresponding to the operated touch switches to visually display tone information inputted by the operated touch switches, and means coupled to said touch switches and to said musical tone generating means for transferring said tone information inputted by said touch switches to said musical tone generating means, whereby said musical tone generating means generates musical tones according to the tone information inputted by said touch switches.

3. The electronic musical instrument of claim 1, wherein said transparent operation plate comprises a display element-divided protruding portion thereon.

4. The electronic musical instrument of claim 1 or 2, wherein said display devices comprise liquid crystal display devices.

5. The electronic musical instrument of claim 4, wherein said liquid crystal display devices are stacked immediately below said transparent operation plate.

6. An electronic musical instrument comprising;

a plurality of performance keys selectively operable to cause the production of sounds corresponding to respective notes, detecting means coupled to said performance keys for detecting the operation of said performance keys, musical tone generating means coupled to said detecting means, for generating musical tones designated by operated performance keys, and an input device coupled to said musical tone generating means for inputting tone information such as volume and timbre of tones selectively generated by said musical tone generating means upon operation of said performance keys, and wherein said input device further comprises:

a plurality of display devices, each having a plurality of display elements for displaying weighting levels of tone status of the musical tones generated by the musical tone generating means, the weighting levels having a given order, wherein said display elements are continuously arranged relative to each other according to the order of said weighting levels, a plurality of transparent touch switches located over said display devices for selectively inputting tone information, drive means coupled to said display devices and to said touch switches, and being responsive to operation of respective touch switches to cause said display elements respectively corresponding to the operated touch switches to visually display tone information inputted by the operated touch switches, and means coupled to said touch switches and to said musical tone generating means for transferring said tone information inputted by said touch switches to said musical tone generating means, whereby said musical tone generating means generates musical tones according to the tone information inputted by said touch switches.

7. The electronic musical instrument of claim 6, wherein said display devices include a plurality of rows of display elements for displaying a plurality of feet lengths of tones generated by said musical tone generating means, each of said rows of display elements being arranged in an increasing order of feet lengths.

8. The electronic instrument of claim 6, wherein upon operation of a touch switch corresponding to one weighting level of the tone status, said drive means causes the display of all the display elements of weighting levels lower than said one weighting level.

* * * * *

UNITED STATES PATENT AND TRADEMARK OFFICE

CERTIFICATE OF CORRECTION

PATENT NO. : 4,440,057

DATED : April 3, 1984

INVENTOR(S) : Masanori ISHIBASHI

It is certified that error appears in the above-identified patent and that said Letters Patent is hereby corrected as shown below:

COLUMN 9 (claim 3), line 36, change "claim 1" to read --claim 2--.

Signed and Sealed this

*Sixth* Day of *November 1984*

[SEAL]

*Attest:*

GERALD J. MOSSINGHOFF

*Attesting Officer*

*Commissioner of Patents and Trademarks*